US005289975A

United States Patent [19]

Miller et al.

[11] Patent Number: 5,289,975

[45] Date of Patent: Mar. 1, 1994

[54] METHOD AND APPARATUS FOR ATOMIZING MOLTEN METAL

[75] Inventors: Steven A. Miller, Amsterdam, N.Y.; Russell S. Miller, Ballston Spa, both of N.Y.

[73] Assignee: General Electric Company, Schenectady, N.Y.

[21] Appl. No.: 900,369

[22] Filed: Jun. 18, 1992

[51] Int. Cl.[5] ..... B05B 7/00

[52] U.S. Cl. ..... 239/79; 239/424

[58] Field of Search ..... 239/8, 79, 424, 433; 264/12; 425/7

[56] References Cited

U.S. PATENT DOCUMENTS

| | | | |
|---|---|---|---|
| 3,501,802 | 3/1970 | Ullman et al. | 425/7 |
| 3,988,084 | 10/1976 | Esposito et al. | 239/424 |
| 4,612,045 | 9/1986 | Shintaku | 239/79 |
| 4,619,597 | 10/1986 | Miller | 425/7 |
| 4,619,845 | 10/1986 | Ayers et al. | 239/79 |
| 4,631,013 | 12/1986 | Miller | 425/7 |
| 4,646,968 | 3/1987 | Sablatura | 239/79 |
| 4,778,516 | 10/1988 | Raman | 75/0.5 |
| 4,801,412 | 1/1989 | Miller | 264/12 |
| 5,125,574 | 6/1992 | Anderson et al. | 239/79 |

OTHER PUBLICATIONS

"The Intelligent Control of an Inert-Gas Atomization Process", S A Osella, S D Ridder, F S Biancaniello and P I Espina, JOM-Jan. 1991, pp. 18-21.

"Production and Characterization of Rapidly Solidified Steel, Superalloy and Titanium Alloy Powders Made by Gas Atomization", J H Moll, ASM Symposium, May 12-13, 1992, pp. 1-20.

"Flow Mechanisms in High Pressure Gas Atomization", I E Anderson, R S Figliola, H. Morton, Materials Science and Engineering, A148 (1991) pp. 101-114.

*Primary Examiner*—Andres Kashnikow
*Assistant Examiner*—Lesley D. Morris
*Attorney, Agent, or Firm*—James Magee, Jr.

[57] ABSTRACT

A nozzle for atomizing molten metal to provide a powder having improved yield of fine particles is disclosed. The nozzle is comprised of a gas plenum, a melt delivery tube, and an annular inner wall means within the gas plenum for delivering atomizing gas to the exit orifice of the melt delivery tube. The exit orifice of the melt delivery tube has a ratio of inside diameter to outside diameter that provides a reduced flow of liquid through the tube during atomization.

3 Claims, 11 Drawing Sheets

METHOD AND APPARATUS FOR ATOMIZING MOLTEN METAL

This invention relates to atomizing molten metal to form metal powders. More particularly, it relates to a nozzle and method of operation for preparing metal powders having a fine particle size.

There is a growing industrial demand for ultra fine metal powders, e.g., powders having a particle diameter smaller than 37 microns. Accordingly, there is a need to develop metal atomization nozzles and methods which can increase the yield of such ultra fine powder, and narrow the distribution of particle sizes formed. U.S. Pat. Nos. 4,619,845 and 4,778,516 disclose commercially available confined feed, also known as close coupled, nozzles, and methods of operating the nozzles for forming such metal powders. The nozzles are comprised of a melt delivery tube having an exit orifice positioned within an annular array of gas jets. The gas jets flow at supersonic speeds, and impinge on a stream of molten metal exiting the orifice to atomize the stream and form the metal powder.

The U.S. Pat. Nos. 4,619,845 and 4,778,516 disclose the known close coupled nozzles can be operated by increasing the inlet pressure to the gas jets until the pressure at the exit orifice of the melt delivery tube drops. The gas jet pressure can be increased until a vacuum, known as the aspiration vacuum, forms at the exit end of the melt tube. In other words, the nozzles are operated at a pressure that increases the flow rate of molten metal through the melt delivery tube due to the the aspiration vacuum formed by the atomizing gas jets. The aspirating vacuum can be formed at atomizing gas pressures ranging from about 8 to 19 MPa.

U.S. Pat. Nos. 4,619,597 and 4,801,412, incorporated herein by reference, disclose close coupled nozzles having a continuous surface from the gas plenum delivering the annular gas jet to the melt delivery tube tip, the tip having a concave configuration so that the atomizing gas is deflected at the tip. U.S. Pat. No. 4,631,013 discloses a similar nozzle having a melt delivery tube with various exit orifice configurations that improve atomization of the molten metal.

One aspect of this invention is to provide a nozzle for atomizing molten metal to form metal powders with an improved yield of fine particles.

Another aspect of this invention is to provide a nozzle for atomizing molten metal having a preselect ratio of inside diameter to outside diameter at the exit orifice of the melt delivery tube.

BRIEF DESCRIPTION OF THE INVENTION

A nozzle for atomizing molten metal is comprised of a plenum means comprised of a cylindrical housing having a plenum top and an adjustably mounted plenum bottom defining a cylindrical channel therein. A melt delivery tube extends axially through the plenum top and the plenum bottom to an exit end section having an exit orifice. The exit orifice having an inside diameter and an outside diameter. The plenum top having an axial bore defined by a rim support means for supporting the melt delivery tube.

An annular inner wall means extends from the plenum top to the exit orifice axial to the melt delivery tube. The inner wall means having a frustum shaped outer surface narrowing at the exit orifice dividing the cylindrical channel into a first annular channel. The exit end section having an outer surface forming a first frustum section of the inner wall means. The plenum bottom having an atomizing gas orifice axial to and spaced from the inner wall means defining a second annular channel therebetween. The cylindrical housing having a gas supply tube extending therethrough. The exit orifice having a ratio of the inside diameter to the outside diameter preselected to provide a reduction in the flow rate of liquid through the melt tube during atomization.

As used herein, the term "two phase flow" means both liquid and atomizing gas are flowing from the nozzle, and the term "single phase flow" means only liquid is flowing from the nozzle, i.e. atomizing gas is not flowing from the nozzle. In other words, during two phase flow liquid flows from the exit orifice, and atomizing gas is flowing from the atomizing gas orifice. During single phase flow liquid is flowing from the exit orifice, but atomizing gas is not flowing from the atomizing gas orifice.

DETAILED DESCRIPTION OF THE INVENTION

Figure 1:
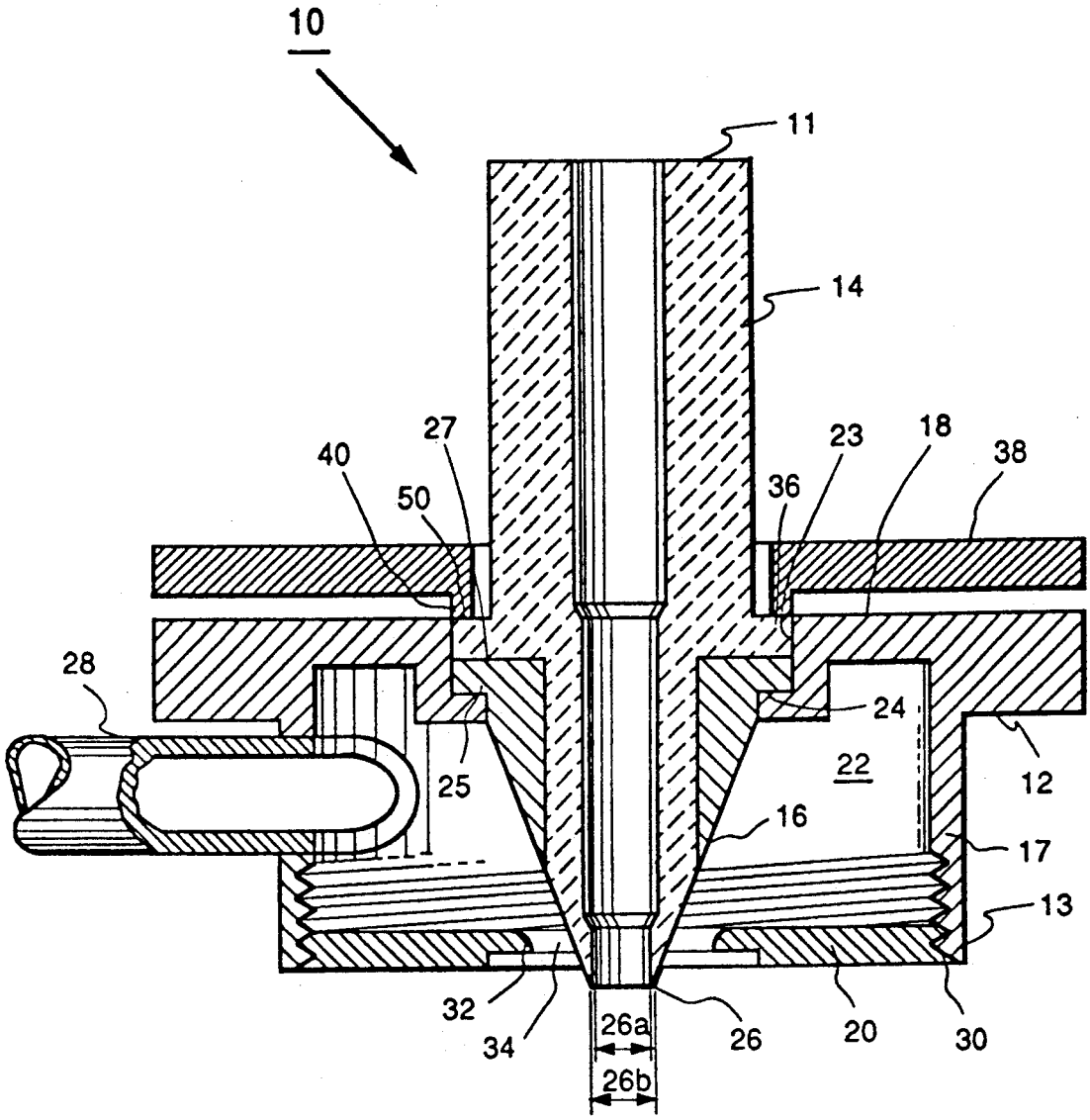
FIG. 1 is a side view cross section of a nozzle for atomizing molten metal according to the invention.

Referring to FIG. 1, there is shown an atomization nozzle 10. Nozzle 10 is comprised of a plenum means 12, melt delivery tube 14, and annular inner wall means 16. Plenum means 12 is preferably formed from a suitable steel, and has a cylindrical housing 17, a plenum top 18, and an adjustably mounted plenum bottom 20 forming a cylindrical channel 22 therein. The plenum top 18 is formed with an axial bore 23 defined by a rim support means such as shelf 24 for axially supporting melt delivery tube 14.

The melt delivery tube 14 extends axially through plenum top 18, and plenum bottom 20 to an exit orifice 26. Liquid metal is poured from a molten metal reservoir, such as a ceramic crucible, into an upper end 11 of the melt delivery tube 14, and flows through the tube to the exit orifice 26 where it emerges for atomizing. The melt delivery tube 14 is formed from a ceramic material that is resistant to reaction with the molten metal, and has good resistance to thermal shock, such as boron nitride or zirconia. The exit orifice 26 has an inside diameter **26*A* and an outside diameter 26*b***.

The ratio of the inside diameter to the outside diameter **26*b* is preselected to provide a reduction in the flow of liquid from the tube 14 when the atomizing gas jet is flowing from the second orifice 34**. In prior art nozzles, atomizing gas pressure can be increased until an aspiration vacuum is formed at the exit end of the nozzle which increases the flow rate of liquid from the melt tube. Surprisingly, a preselect ratio of inside diameters to outside diameters for the melt tube exit orifice in the nozzle of this invention have been found, that provide a reduction in the flow rate of liquid from the tube when the atomizing gas is flowing. As the pressure of the atomizing gas in the nozzle is increased the flow rate of liquid from the tube increases to a maximum and then decreases. However, the flow rate of liquid from the nozzle during single phase flow is always greater than the flow rate of liquid from the nozzle during two phase flow. In other words, the nozzle of this invention does not aspirate.

It has also been found that the nozzles of this invention having the exit orifice with a preselect ratio of inside diameter to outside diameter provide an improved yield of fine particles during atomization. For example, a nickel based superalloy powder having a particle size of about 37 microns or less can be formed with a yield of up to about 70 percent in nozzles of this invention.

The preselect ratio of inside diameter to outside diameter depends on the outside diameter of the tube. As the outside diameter increases, the ratio can decrease. For example, a melt tube having an exit orifice with an outside diameter of about 4.7 mm can have a ratio down to about 90 percent, i.e., an inside diameter of about 4.2 mm. A melt tube having an exit orifice with an outside diameter of about 9.5 mm. can have a ratio down to about 65 percent, i.e., an inside diameter of about 6.2 mm. Nozzles of this invention can be operated with melt tubes having an inside diameter from about 3 to 26 millimeters.

The annular inner wall means 16 extends from the plenum top 18 to orifice 26, and has an outer surface that forms a frustum dividing channel 22 into an annular channel. The inner wall means can be formed from a suitable steel, or ceramic, and is preferably part of tube 14. The inner wall means 16 is supported from shelf 24 by flange 25. The frustum shaped outer surface of inner wall means 16 is narrowest at orifice 26 so that the apex angle of the frustum is below the orifice 26. The apex angle of the frustum can range from about 20 to 60 degrees, and preferably is 42 to 46 degrees.

Tube 14 has a mid-flange 36, supported on an upper surface 27 of the inner wall means 16, and provides a preselect vertical location of the tube in the nozzle 10 and the inner wall means 16. An upper annular ring 38 has an inner depending boss 40 which presses along flange 36 to hold the tube and inner wall means of the nozzle in precise alignment. The means for holding the nozzle assembly in the related apparatus in which molten metal is atomized is conventional and forms no part of this invention.

The plenum bottom 20 is adjustably mounted to cylindrical housing 17 for example by conventional mating threads 30. The plenum bottom 20 is formed with an orifice 32 axial to and spaced from inner wall means 16 to form a second annular channel 34 therebetween. The orifice 32, can have surfaces formed in a bevelled shape to conform generally to the inner wall means 16. The size of second annular channel 34 can be adjusted by turning the plenum bottom 20 in threads 30 towards or away from inner wall means 16. The width of the second annular channel, sometimes herein referred to as the "atomizing gas channel gap" can range from about 0.64 to 2.8 millimeters, preferably about 1.3 to 2.2 millimeters, and most preferably about 1.5 millimeters.

The cylindrical housing 17 has a gas supply tube 28 extending therethrough to provide atomizing gas to channel 22. The molten metal emerging from tube 14 at orifice 26 is swept by a gas jet. The annular gas jet is made up of gas streaming from the annular channel 22 downwardly through the second annular channel 34 formed between the inner wall means 16 and the gas orifice 32. The gas jet impinges on the stream of molten metal descending through tube 14 and emerging from the exit orifice 26, and atomizes the stream to form a powder of the metal. The nozzle of this invention can form powder particles having an improved yield of fine particles, e.g. particles less than 37 microns.

Figure 2:
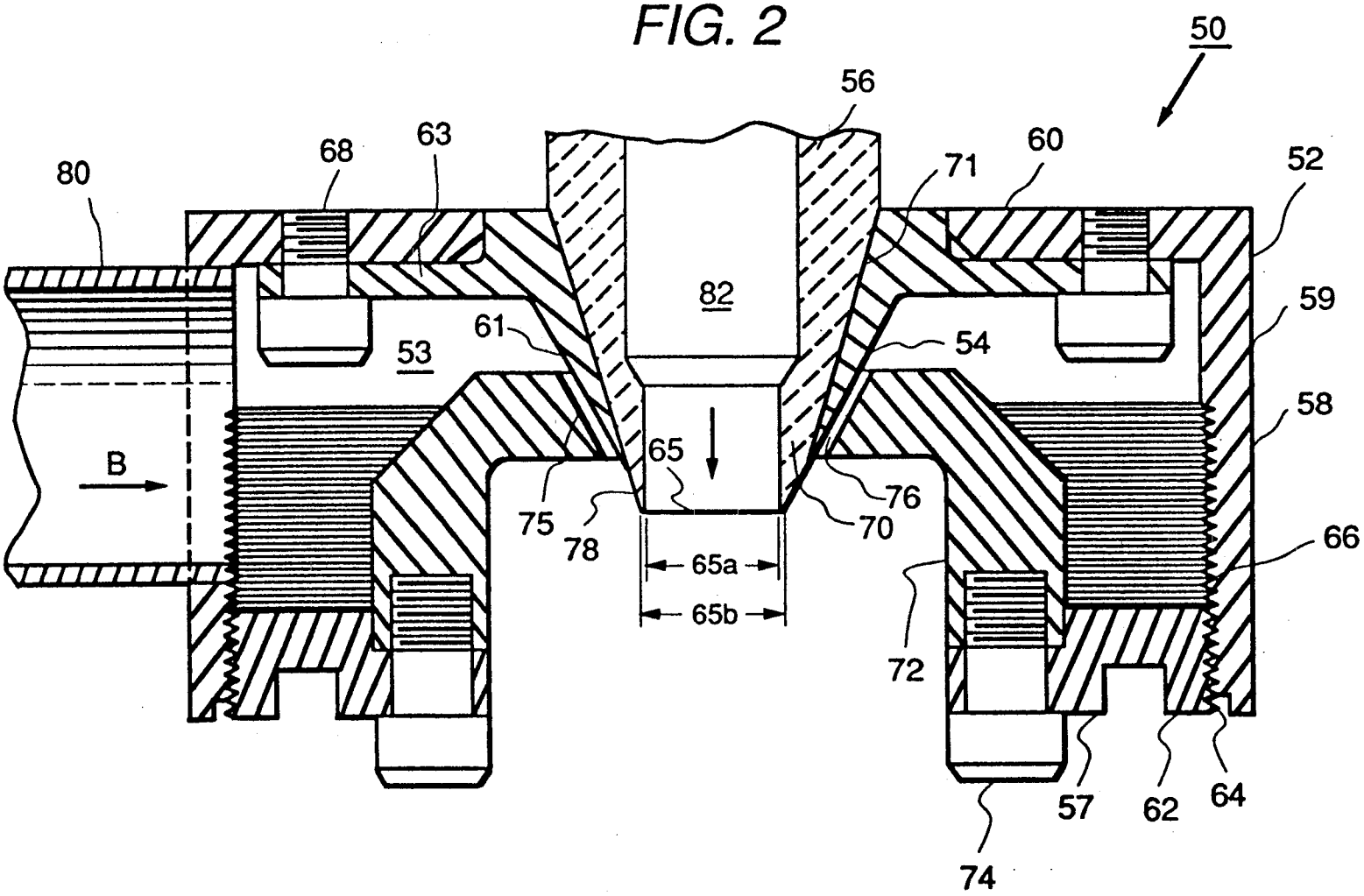
FIG. 2 is a side view cross section of another nozzle for atomizing molten metal according to the invention.

Another nozzle of this invention is shown in FIG. 2. Nozzle 50 is comprised of a plenum means 52, annular inner wall means 54, and melt delivery tube 56, each formed from suitable steel or ceramic material as described above. The plenum means 52 is comprised of an annular bracket 58, and plenum bottom 57 defining inner chamber 53. The bracket 58 forms a cylindrical housing 59 and plenum top 60. The tube 56 extends axially through the plenum top 60 and the plenum bottom 57 to an exit orifice 65. A conical section 61 of the inner wall means 54 extends from the plenum top 60 to near the exit orifice 65, and forms a frustum coaxial to the plenum means 52 dividing the inner channel 53 into a first annular channel. A flange 63 extends from the wider end of the conical section 61 for rigid attachment by conventional fasteners 68 to plenum top 60.

The melt delivery tube 56 has an exit end section 70 having a tapered outer surface for mating with the inner surface 71 of the conical section 61. The inner surface 71 of the conical section 61 is the rim support means coaxially supporting the tube 56 in the plenum means 52. A first frustum section 78 of the exit end section 70 of melt tube 56 extends beyond conical section 61, forming the first frustum section of the inner wall means 54. The outer surface of the conical section 61 extending from plenum top 60 to the first frustum section 78 forms a second frustum section of the inner wall means 54.

First frustum section 78 has an apex angle substantially the same, or up to about 15 degrees less than the apex angle of the second frustum. The first frustum can have an apex angle of about 20 to 60 degrees, and the second frustum can have an apex angle of about 40 to 60 degrees. Preferably, the apex angle of the first frustum is about 24 to 31 degrees, and most preferably about 29 degrees. Preferably, the apex angle of the second frustum is about 42 to 46 degrees, and most preferably about 44 degrees.

The plenum bottom 57 is formed from an annular disk 62, having outer threaded surface 64 for mating with the threaded inner surface 66 on bracket 58, and a second annular bracket 72 is rigidly attached to annular disk 62 by conventional fasteners 74. The annular bracket 72 has a gas orifice 75 having a surface facing the inner wall 54, defining second annular channel 76 therebetween. The gas orifice 75, can have surfaces formed in a bevelled shape to conform generally to the inner wall means 54. The size of second annular channel 76 can be adjusted by turning the plenum bottom 57 in threads 66 towards or away from inner wall means 54.

The second frustum of the inner wall means 54 can extend beyond the plenum bottom, i.e. the gas orifice 75. The second frustum provides additional protection from the atomizing gas to the first frustum section 78 of the melt tube extending therefrom. The high pressure atomizing gas applies stresses to the first frustum section 78 from the force of the expanding gas, and the thermal shock from the reduction in temperature of the expanding gas. For example, the second frustum can extend up to about 6 millimeters beyond the plenum bottom. The first frustum section of the tip section 78 can extend about 1 to 7 millimeters, preferably the lower part of the range, from the second frustum section to provide the desired atomizing gas flow at the exit orifice 65.

A gas supply tube 80 extends through cylindrical housing 59. An atomizing gas such as argon, helium, or nitrogen is introduced through gas supply tube 80 by a conventional gas transportation device, not shown. The atomizing gas proceeds along the direction of arrow B at a pressure of about 0.7 to 7 MPa into annular chamber 53, and through the second annular channel 76. As a melt flow 82 proceeds through tube 56, flow 82 interacts with the atomizing gas below the exit orifice, and is atomized to form a metal powder.

It has been found that nozzles of this invention can be operated at atomizing gas pressures substantially lower than the prior art nozzles, for example shown in U.S. Pat. Nos. 4,619,845 and 4,778,516. Further, it has been found that the nozzles of this invention can be operated at the lower pressures while providing higher yields of fine metal powders, for example below 37 microns, as compared to the prior art nozzles. In other words, the nozzles of this invention will provide an improved yield of fine metal powder, at a reduced atomizing gas pressure as compared to prior art nozzles.

The nozzles of this invention do not operate in an aspirating mode, i.e., the flow rate of liquid metal from the tube does not increase during atomization. In contrast, the nozzles of this invention are operated so that the flow rate of molten metal through the tube is reduced during atomization.

Additional features and advantages of the nozzles, and method of operating the nozzles of this invention is shown in the following Examples. In the following Examples, a nozzle having the general configuration shown in FIG. 2 was used with melt delivery 56 formed with various inside diameter 65*a* and outside diameters 65*b* at the exit orifice 65. The atomizing gas was argon, and the melt delivery tubes were formed from boron nitride.

EXAMPLE 1

A nozzle having a melt delivery tube with an outside diameter of 5.2 millimeters, and an inside diameter of 4.75 millimeters was operated at various gas flow rates to determine the pressure at the exit orifice of the melt delivery tube. The nozzle was configured as follows: atomizing gas channel gap 0.76 millimeters, gas orifice 9.8 millimeters, apex angle first frustum 29.4°, second frustum 44°, second frustum extension from plenum bottom 0.85 millimeters, first frustum extension from second frustum 3.58 millimeters.

Figure 3:
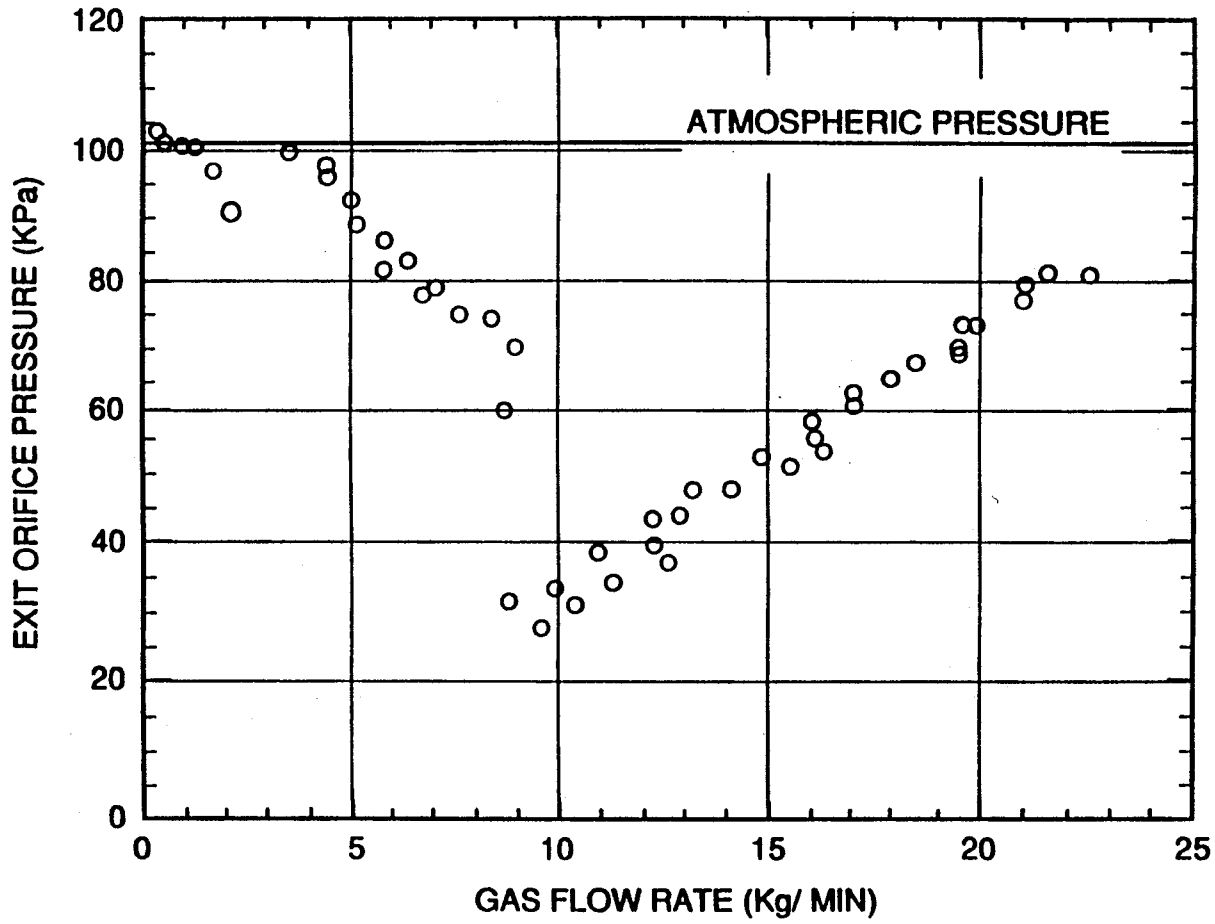
FIGS. 3 and 4 are graphs showing the pressure at the melt delivery tube exit orifice as a function of atomizing gas flow rates in nozzles of this invention.

The melt delivery tube was sealed at the pressure transducer was inserted in the melt delivery tube. An argon atomizing gas was delivered to the nozzle at various flow rates, and the resulting pressure in the melt delivery tube was recorded. FIG. 3 shows the exit orifice pressure in kilopascals (KPa) plotted on the ordinate, and the gas flow rates in kilograms per minute (Kg/min) plotted on the abscissa. The gauge pressure being the difference between the atmospheric pressure and the measured pressure.

EXAMPLE 2

Figure 5:
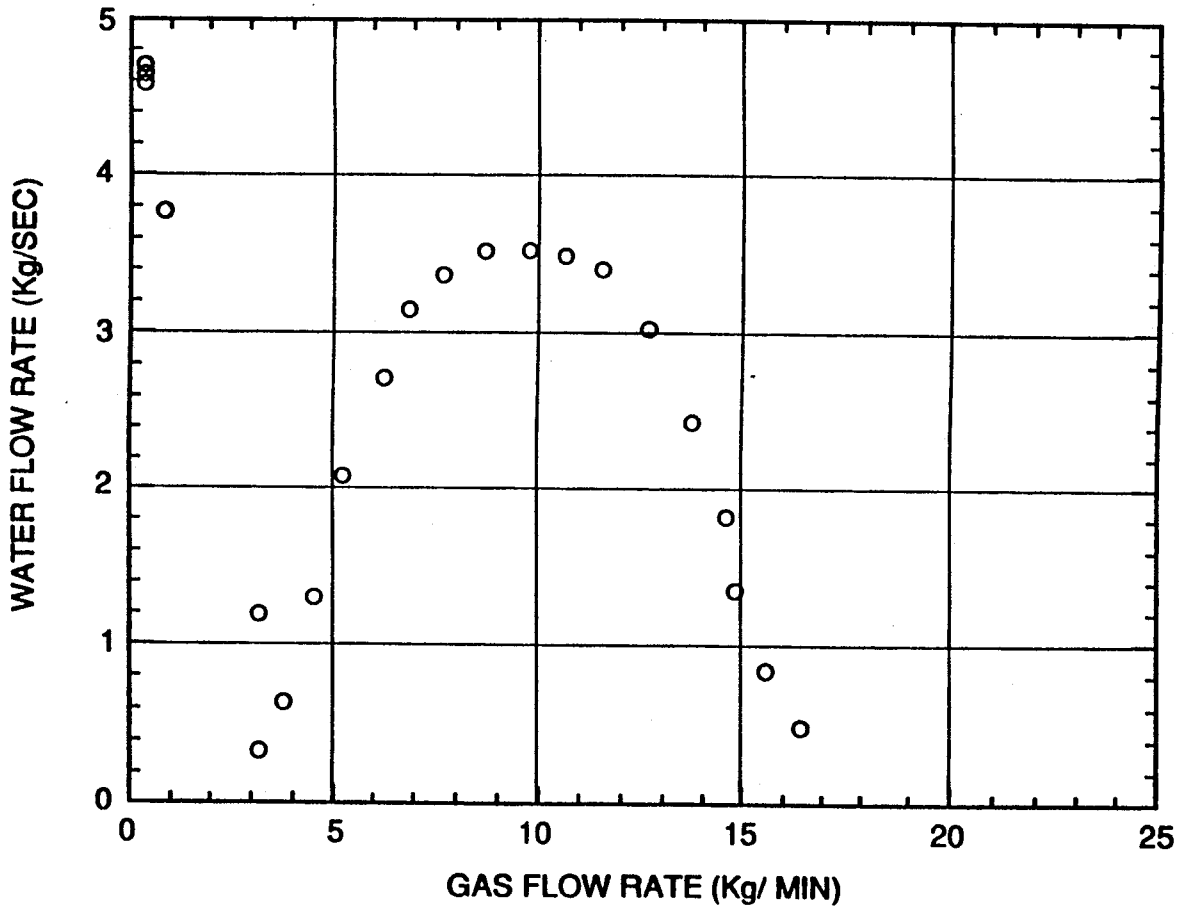
FIGS. 5 and 6 are graphs showing the flow rate of water from the melt delivery tube as a function of atomizing gas flow rate in nozzles of this invention.

The nozzle in Example 1 was operated by connecting the melt delivery tube to a water reservoir having a constant static head pressure of about 14 KPa, and providing argon atomizing gas at various flow rates. The water flow rate through the melt delivery tube was determined for the various atomizing gas flow rates. FIG. 5 is a graph showing the water flow rate in kilograms per second plotted on the ordinate, as a function of atomizing gas flow rates in kilograms per minute plotted on the abscissa. The data points plotted farthest to the left on the ordinate show the single phase flow rate of water through the melt tube.

EXAMPLES 3 and 4

Figure 4:
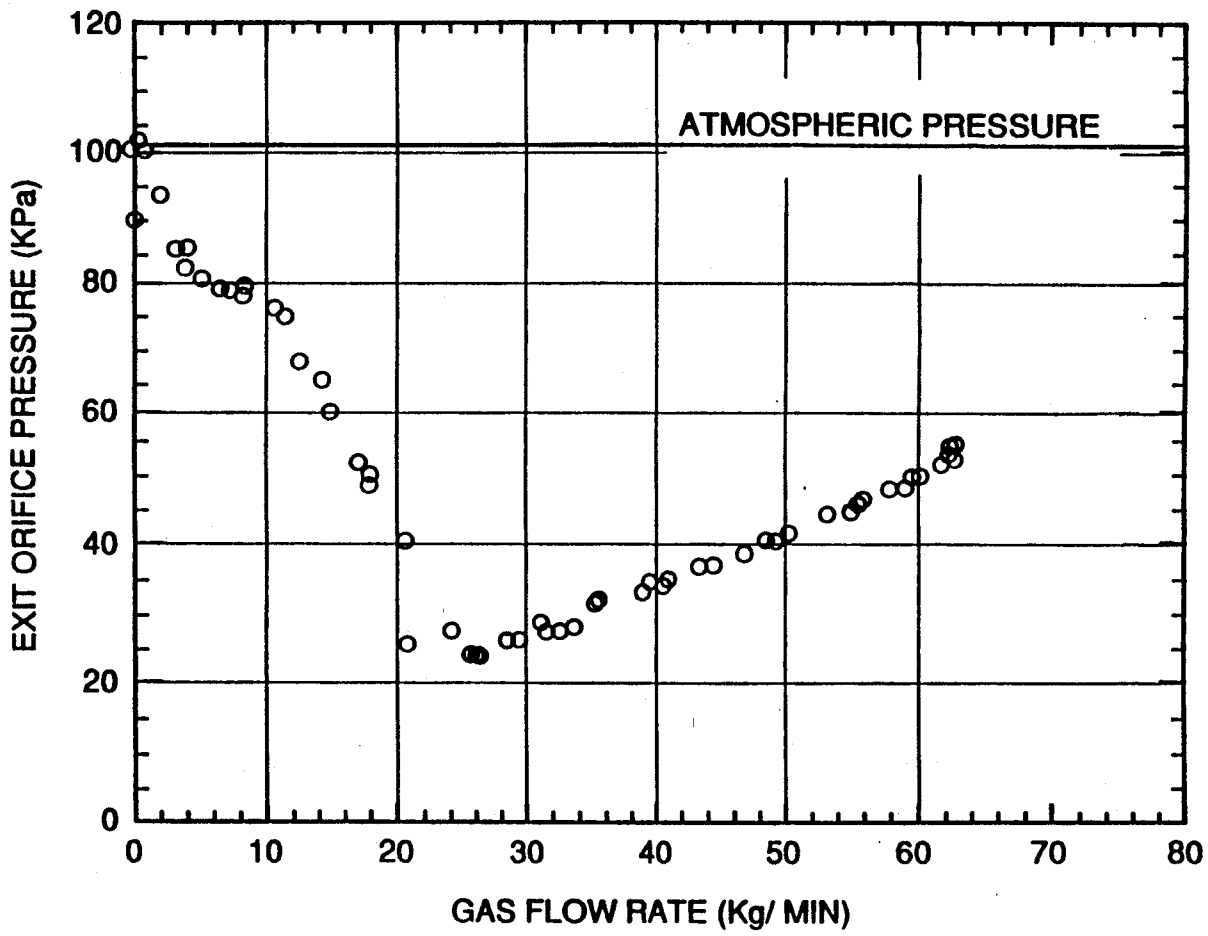
Figure 6:
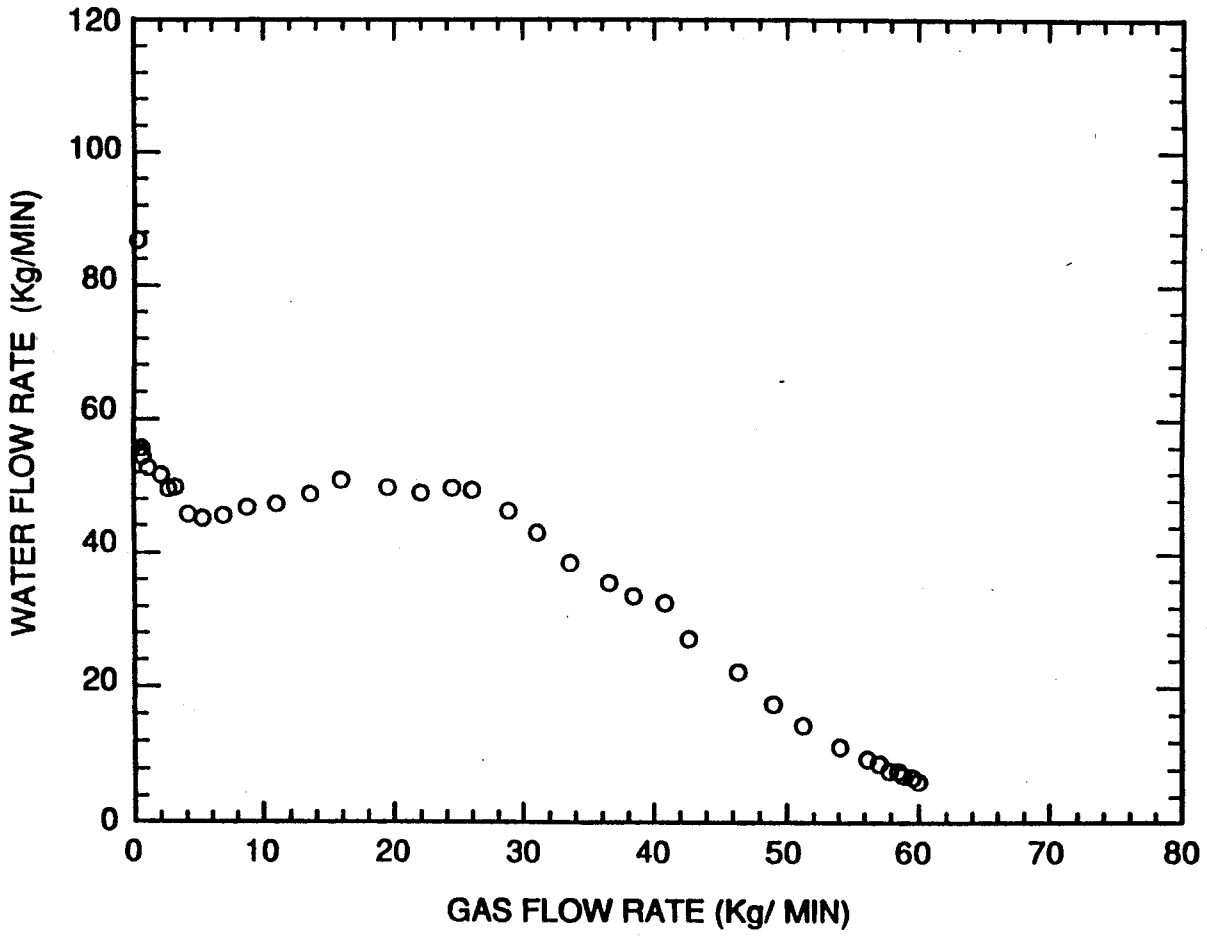

A nozzle having a melt delivery tube with an exit orifice having an outside diameter of 10 millimeters, and an inside diameter of 9.5 millimeters was operated at various gas flow rates to determine the pressure at the exit orifice of the melt delivery tube. The nozzle was configured as follows: atomizing gas channel gap 2 millimeters, gas orifice 17.3 millimeters, apex angle first frustum 29°, second frustum 44°, second frustum extension from plenum bottom 3.3 millimeters, first frustum extension from second frustum 3.3 millimeters. Tests were performed on the 9.5 millimeter exit orifice nozzle as in Examples 1 and 2. FIGS. 4 and 6, corresponding to FIGS. 3 and 5, show the melt delivery tube pressure and water flow rates as a function of atomizing gas flow rate.

FIGS. 3 and 4 show that as the flow rate of atomizing gas is increased, the pressure in the melt delivery tube decreases below the one atmosphere pressure in the tube when no gas is flowing to a minimum, and then increases but remains below atmospheric pressure. Although FIGS. 3 and 4 show pressure in the melt delivery tube decreases when atomizing gas flows from the nozzle, FIGS. 5 and 6 show that when a liquid is being atomized, the atomizing gas provides a reduction in the liquid flow rate in the melt tube, i.e. the nozzle does not aspirate as in the prior art nozzles. As the atomizing gas flow rate increases the flow rate of water increases to a maximum and slowly decreases, but the maximum is below the flow rate of the water when no atomizing gas was flowing, as shown in FIGS. 5 and 6.

As a result, it can be seen that the nozzles of this invention do not provide an aspiration vacuum. The atomizing gas reduces the flow rate of liquid through the melt delivery tube as compared to the flow rate when no atomizing gas is provided.

EXAMPLE 5

Figure 7:
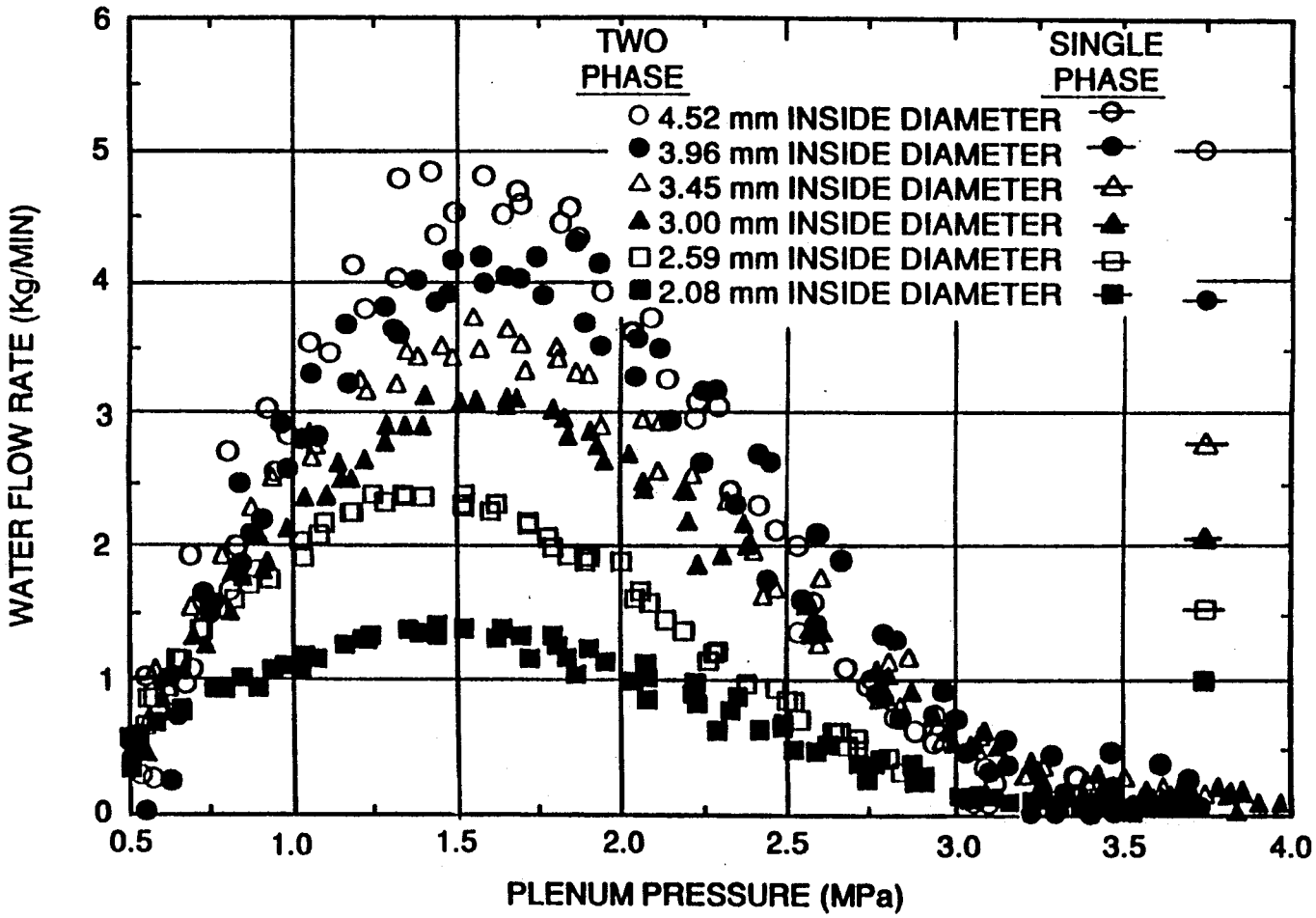
FIGS. 7–9 are graphs showing the water flow rate from melt delivery tubes having various ratios of inside diameter to outside diameter at the exit orifice.
Figure 8:
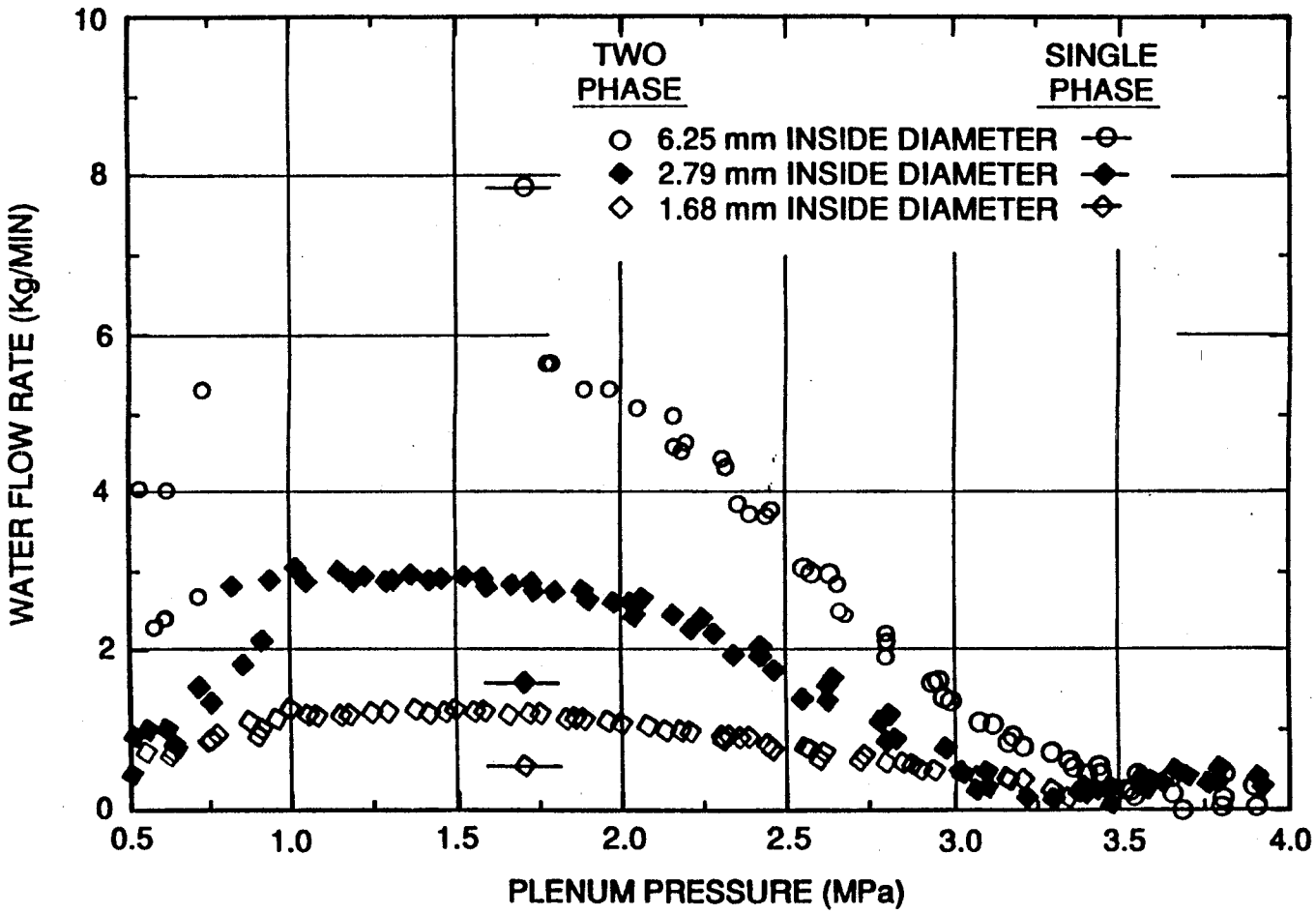
Figure 9:
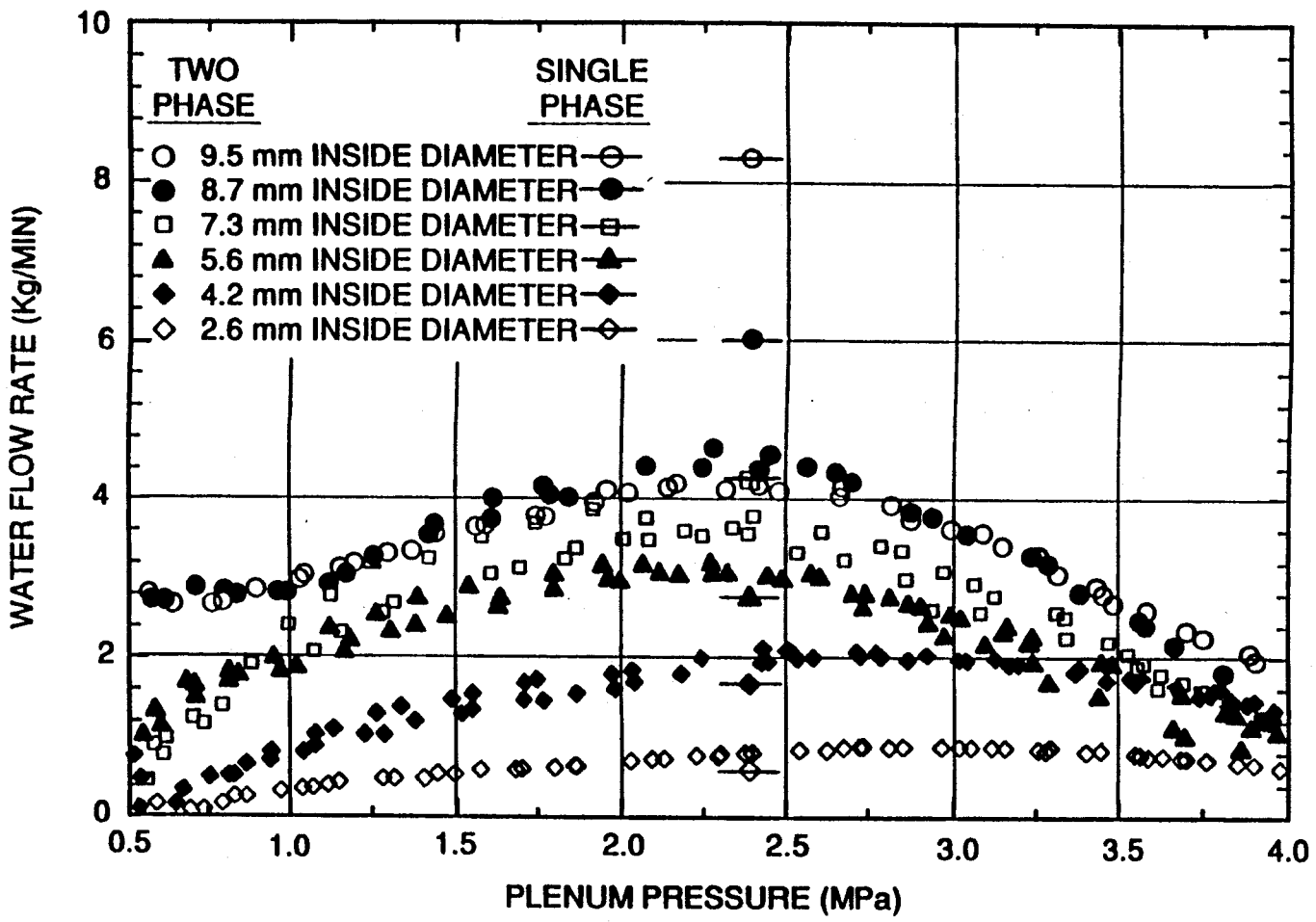

A nozzle was operated with melt delivery tubes having exit orifices with various ratios of inside diameter to outside diameter. The nozzle was operated in single phase and two phase flow with various plenum pressures while measuring water flow from the exit orifice. FIGS. 7, 8 and 9 show the water flow rate in kilograms per minute as plotted on the ordinate, as a function of plenum pressure in megapascals (MPa) as plotted on the abscissa for melt tubes having outside diameters of 4.7, 6.35, and 9.5 millimeters respectively.

The nozzle having the 4.7 millimeter outside diameter exit orifice was configured as follows: atomizing gas channel gap 1.5 millimeters, gas orifice 12 millimeters, apex angle first frustum 29.2° second frustum 44°, second frustum extension from plenum bottom 1.8 millimeters, first frustum extension from second frustum 4.6 millimeters. The nozzle having the 6.35 millimeter outside diameter exit orifice was configured as follows: atomizing gas channel gap 1.5 millimeters, gas orifice 14 millimeters, apex angle first frustum 29° second frustum 44°, second frustum extension from plenum bottom 2.1 millimeters, first frustum extension from second frustum 4.3 millimeters. The nozzle having the 9.5 millimeter outside diameter exit orifice was configured as follows: atomizing gas channel gap 1.55 millimeters, gas orifice 17 millimeters, apex angle first frustum 29° second frustum 44°, second frustum extension from plenum bottom 2.5 millimeters, first frustum extension from second frustum 4.1 millimeters.

FIG. 7 shows that the two phase flow rate was less than the single phase flow rate in the melt tubes having an exit orifice outside diameter of 4.7 millimeters and an inside diameter of 4.52 millimeters. FIG. 8 shows the two phase flow rate was less than the single phase flow rate in the melt tubes having an exit orifice outside diameter of 6.35 millimeters and an inside diameter of 6.25 millimeters. FIG. 9 shows the two phase flow rate was less than the single phase flow rate in melt tubes having an exit orifice with an outside diameter of 9.5 millimeters, and an inside diameter of 9.5, 8.7, and 7.3 millimeters.

Figure 10:
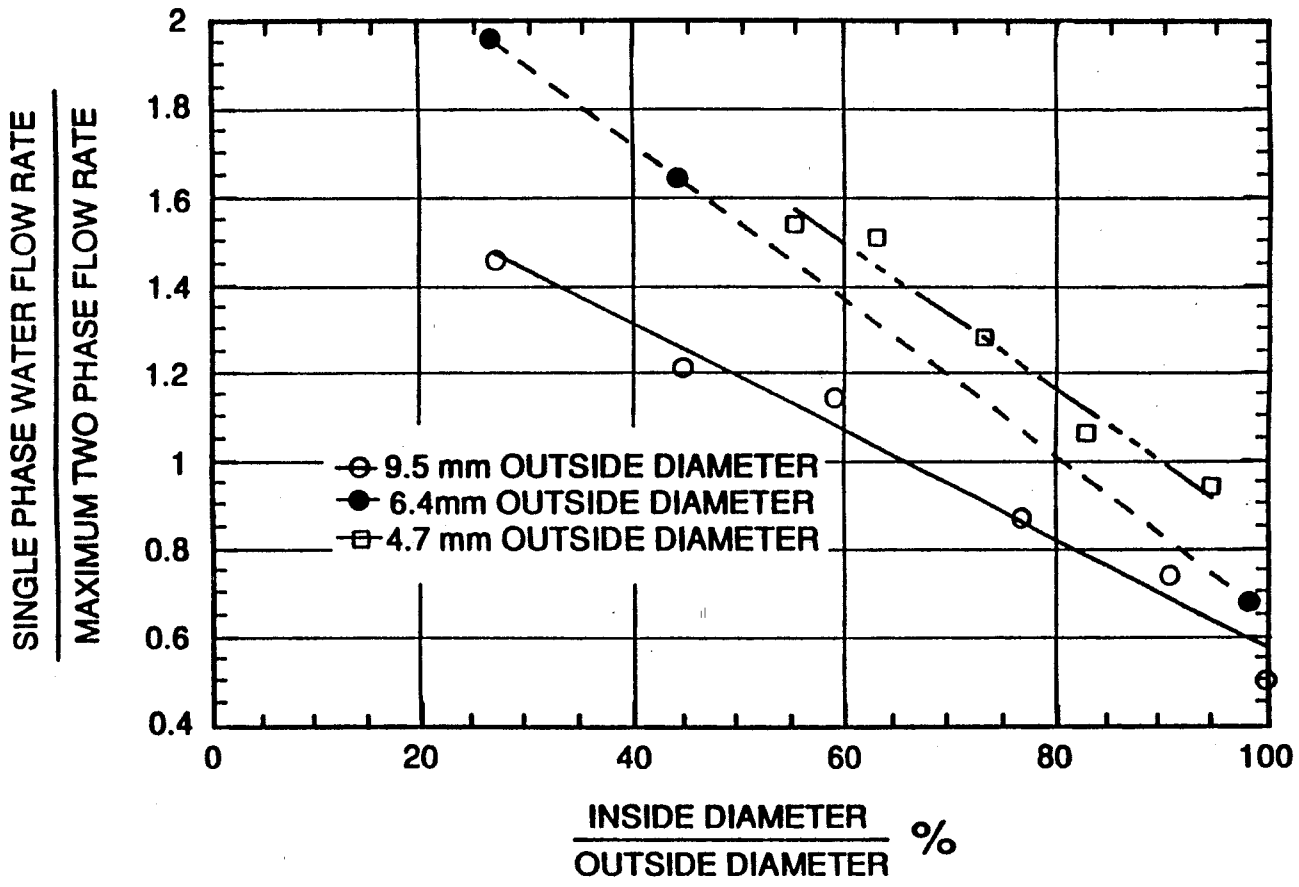
FIG. 10 is a graph showing the ratio of single phase to two phase liquid flow rate from melt delivery tubes having various ratios of inside diameter to outside diameter at the exit orifice.

The ratio of the single phase flow rate to the maximum two phase flow rate, shown in FIGS. 7–9, for each melt tube as a function of the ratio of inside diameter to outside diameter at the exit orifice is shown in FIG. 10. When the ratio of single phase flow to the maximum two phase flow is less than 1, liquid flow in the melt tube was reduced during atomization. When the ratio of single phase flow to maximum two phase flow was greater than 1, liquid flow through the melt tube was increased during atomization, i.e. the nozzle was aspirating.

Surprisingly, it was found that improved yield of fine particles during metal atomization was achieved in the nozzles of this invention that provide a ratio of two phase flow to single phase flow that is less than 1. The metal atomization nozzles of this invention are comprised of melt delivery tubes having an exit orifice with a ratio of inside diameter to outside diameter that reduces the flow of liquid through the melt tube during atomization. The reduced flow of liquid in the melt tube during atomization is shown by the data points below the ratio of 1 in FIG. 10.

In addition, it has been found that improved yield of fine powder is achieved by operating the nozzles of this invention at atomizing gas pressures or flow rates greater than the atomizing gas pressure or flow rates that provide the highest liquid flow rate from the melt delivery tube. For example, referring to FIG. 7, it is shown that the nozzle having a 4.7 mm melt tube with an inside diameter of 4.52 mm had a maximum liquid flow through the tube at an atomizing gas pressure of about 1.6 MPa. Therefore, the nozzle having the melt tube with a 4.52 mm inside diameter can be operated with an atomizing gas pressure of greater than 1.6 MPa, e.g. about 2 to 2.5 MPa, to provide an improved yield of fine powder. In contrast, it is the teaching of the prior art that the prior art close coupled nozzles are operated to achieve improved yield of fine metal powder by providing atomizing gas at a pressure that provides aspiration, or maximum flow of liquid from the melt tube.

EXAMPLE 6

A nozzle having a melt delivery tube with an outside diameter of 9.5 millimeters, and an inside diameter of 9.4 millimeters was operated at various atomizing gas pressures while providing a flow of a nickel based superalloy molten metal through the melt delivery tube at a constant pressure of about 18 kilopascals. The nozzle was configured as in Example for the 9.5 millimeter outside diameter nozzle. A second nozzle having a melt delivery tube with an outside diameter of 4.7 millimeters, and an inside diameter of 4.6 millimeters was operated at various atomizing gas pressures while providing a flow of a nickel based superalloy molten metal through the melt delivery tube at a constant pressure of about 18 kilopascals. The nozzle was configured as in Example 5 for the 4.7 millimeter outside diameter nozzle. Some atomization runs were also performed with various nozzle configurations.

From FIGS. 3 and 4 it can be seen that the atomizing gas provides a reduction in pressure at the exit orifice of the melt tube when no fluid is flowing therethrough. Therefore, a "total gauge pressure" urging the liquid to flow from the melt delivery tube can be determined by measuring the reduction in pressure for various exit orifices having various inside to outside diameter ratios as in Example 1, and adding the static head pressure urging the liquid through the tube. As used herein, the term "calculated single phase liquid flux" means the liquid flux through the tube as determined from using the total gauge pressure in Bernouli's equation modified for pressure drop across a nozzle having a melt tube with an exit orifice having a select ratio of inside diameter to outside diameter. The calculation can be empirically confirmed by applying a static head pressure that is equal to the total gauge pressure, urging the liquid through the tube having an exit orifice with the select ratio of inside diameter to outside diameter.

Figure 11:
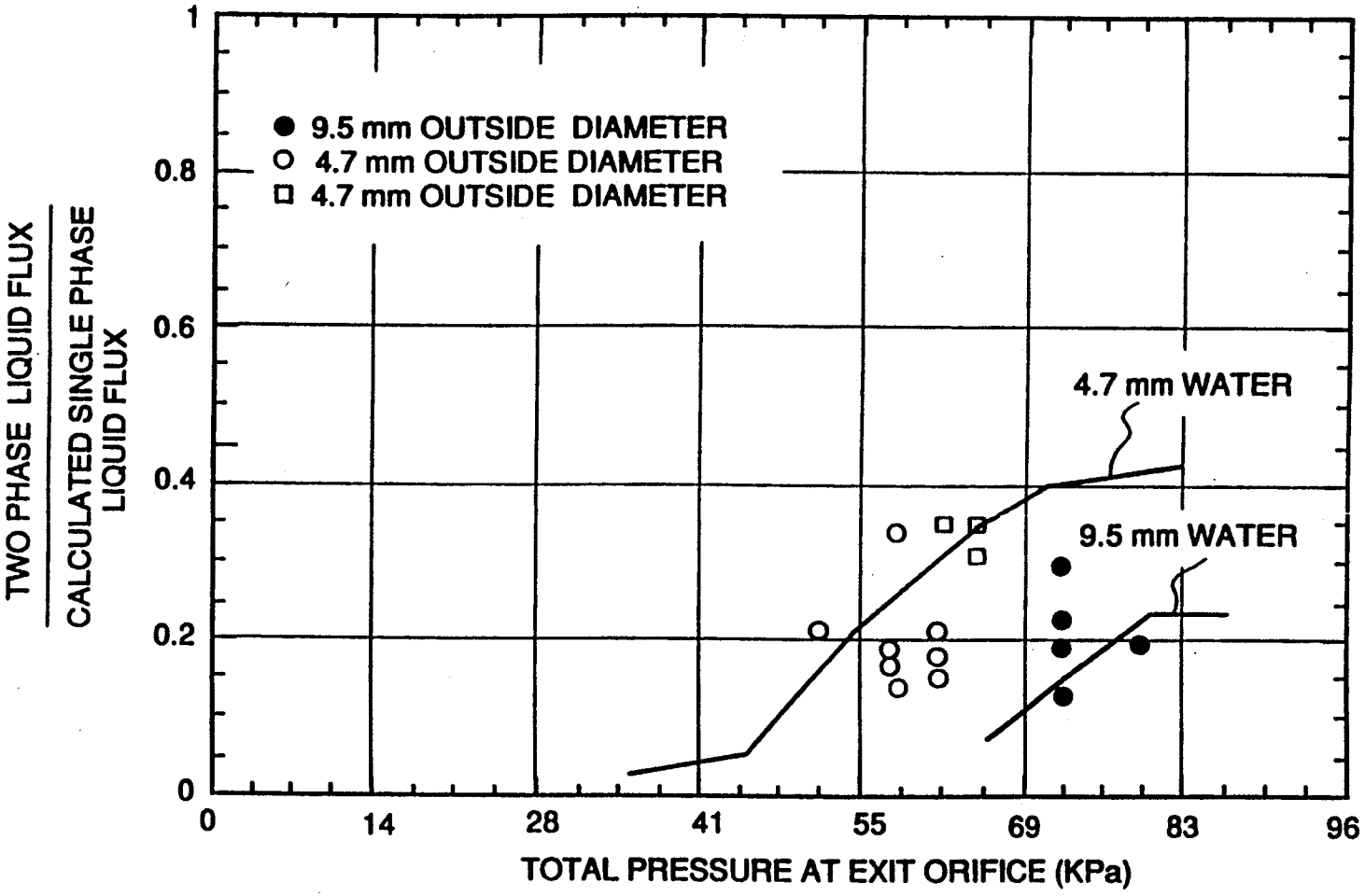
FIG. 11 is a graph showing the atomization mass flux ratio as a function of the total pressure at the exit orifice.

FIG. 11 is a graph showing what is herein referred to as an "atomization mass flux ratio", as a function of the total gauge pressure urging the liquid to flow from the melt delivery tube. The atomization mass flux ratio is the ratio of the two phase liquid flux to the calculated single phase liquid flux.

The atomization mass flux ratio for the molten metal atomization in the nozzle having the 9.5 millimeter exit orifice nozzle configuration in Ex. 5 is plotted as the solid circle data points (•) in FIG. 11. The atomization mass flux ratio for the water atomization in the 9.5 millimeter exit orifice nozzle in Example 5 is plotted on FIG. 11 as a solid line for comparison.

The atomization mass flux ratio for the molten metal atomization in the 4.7 millimeter exit orifice nozzle configuration in Ex. 5 is plotted as the open circle data points (o) in FIG. 11. The atomization mass flux ratio for the water atomization in the 4.7 millimeter exit orifice nozzle in Example 5 is plotted on FIG. 11 as a solid line for comparison. The atomization mass flux ratio for the molten metal atomization in the nozzle having the 4.7 millimeter exit orifice, and various nozzle configurations is plotted as the open square data points (□) in FIG. 11.

FIG. 11 shows that the atomization of water in the nozzles of this invention, is representative of the atomization of molten metal as the liquid flowing through the melt delivery tube. FIG. 11 shows that the atomization mass flux ratio for nozzles of this invention is less than about 0.4. In contrast, nozzles having melt delivery tubes with exit orifices having a ratio of inside diameter to outside diameter not within the limits of this invention, provide maximum atomization mass flux ratios that exceed 0.4, for example up to about 0.82. It was found that powders of high melting temperature metals, e.g. nickel based superalloys, having improved high yields of fine particles, e.g. less than 37 microns, are formed when nozzles of this invention are operated to provide an atomization mass flux ratio less than about about 0.4.

For example, the 4.7 mm exit orifice nozzle having a melt delivery tube with an exit orifice inside diameter of 4.6 mm is shown in FIG. 11 to have an atomization mass flux ratio of about 0.4 or less. An atomizing gas pressure that provides an improved yield of fine metal powder is a pressure that provides an atomization mass flux ratio of less than 0.4. For example, at an atomization mass flux ratio of about 0.225, the total pressure at the exit orifice is about 55 KPa. Subtracting the static head pressure of 18 KPa, the gage pressure at the exit orifice is about 37 KPa. Referring to FIG. 3, the exit orifice gage pressure of 37 corresponds to a gas flow rate of about 17 Kg/min. The nozzle had a 0.76 mm gas gap, and the 17 Kg/min flow rate is a gas pressure of about 4 MPa.

Those skilled in the art can make and use nozzles of this invention having melt delivery tubes with different exit orifice sizes by performing a few simple experiments as shown in Examples 1–6 above.

What is claimed is:

1. A non aspirating nozzle for atomizing molten metal comprising:

a plenum means comprised of a cylindrical housing having a plenum top and a plenum bottom defining a cylindrical channel therein, a melt delivery tube extending axially through the plenum top and the plenum bottom to an exit end section having an exit orifice, the exit orifice having an inside diameter and an outside diameter, the plenum top having an axial bore defined by a rim support means for supporting the melt delivery tube, an annular inner wall means extending from the plenum top to the exit orifice coaxial with the melt delivery tube, the inner wall means having a frustum shaped outer surface narrowing toward the exit orifice dividing the cylindrical channel into a first annular channel, the exit end section of the melt delivery tube having an outer surface forming a first frustum section of the inner wall means, the plenum bottom having an atomizing gas orifice axial to and spaced from the inner wall means defining a second annular channel therebetween, and the cylindrical housing having a gas supply tube extending therethrough, the exit orifice of the melt guide tube having an inside diameter of about 3 to 26 millimeters and having a ratio of the inside diameter to the outside diameter of at least about 65 percent to provide a reduction in the flow rate of liquid through the melt tube during atomization.

2. A nozzle according to claim 1 wherein the first frustum extends about 1 to 7 millimeters beyond the plenum bottom and has an apex angle of about 20 to 46 degrees.

3. A nozzle according to claim 2 wherein the inner wall means has a second frustum section extending from the first frustum section to the plenum top, the second frustum section having an apex at an angle of about 40 to 60 degrees and an apex angle of about 42 to 46 degrees and extends up to about 6 millimeters beyond the plenum bottom.

* * * * *